US005349887A

United States Patent [19]

Suwa

[11] Patent Number: 5,349,887

[45] Date of Patent: Sep. 27, 1994

[54] TUBULAR PIPE WRENCH

[76] Inventor: Kaye Suwa, 4510 Alta Canyada Rd., La Canada, Calif. 91011

[21] Appl. No.: 80,923

[22] Filed: Jun. 21, 1993

[51] Int. Cl.[5] ..... B25B 13/18

[52] U.S. Cl. ..... 81/128; 81/53.2

[58] Field of Search ..... 81/128, 53.2, 3.42; 279/71, 81

[56] References Cited

U.S. PATENT DOCUMENTS

| | | | |
|---|---|---|---|
| 1,425,359 | 8/1922 | Barry | 81/128 X |
| 2,027,534 | 1/1936 | Ingersoll | 81/128 X |
| 2,574,001 | 11/1951 | Weibel et al. | 81/53.2 |
| 2,580,247 | 12/1951 | Secundi et al. | 81/128 X |
| 2,681,582 | 6/1954 | Valvano | 81/128 X |
| 4,932,292 | 6/1990 | Merrick | 81/128 X |

*Primary Examiner*—D. S. Meislin
*Attorney, Agent, or Firm*—Wagner & Middlebrook

[57] ABSTRACT

A tubular pipe wrench for removing and replacing pipes in inaccessible locations includes a generally cylindrical head member having an internal passage large enough to pass the pipe to be worked on and having a cross-sectional configuration like a triangle with greatly rounded corners. A jaw member having teeth is loosely fastened in each of the three corners by bolts which pass through slots in the sidewalls of the head member. Concentric with the head member is a sleeve having ports for receiving the bolts and which maintains the relative spacing of the bolts even though they move radially in the slots. When a pipe is inside of the head member, a slight turning of the head member and sleeve in either direction causes the teeth of the jaw members to make contact with the pipe, moving the jaws into a position where they are wedged between the pipe and the flattened cam surfaces on the inside of the head. Further turning of the sleeve and head will turn the pipe. An extension member which is also cylindrical has a castellated interconnection with the head member. A drive member has a similar castellated interconnection with the extension member and flattened surfaces to be turned with a conventional wrench.

13 Claims, 3 Drawing Sheets

TUBULAR PIPE WRENCH

BACKGROUND OF THE INVENTION

This invention relates to wrenches for threading and unthreading pipes and more particularly to a specialized wrench adapted for working on pipes in locations which are difficult to reach.

Almost any homeowner who has attempted to do any plumbing around his house is aware that some installations are located and arranged such that it is very difficult, if not impossible, to attach a conventional pipe wrench to the pipe which it is desired to turn without costly removal of structure or fixtures. If one succeeds in getting access to the pipe, the next obstacle is that there is inadequate room to move the wrench handle and if it can be turned at all, the wrench must be reset after turning the pipe every few degrees. Professional plumbers often find a need to remove and replace pipes which are carried in walls where access is extremely difficult even when access panels or wall panels are removed. A typical example of a problem installation is shown in FIG. 1, discussed below, where pipes supplying bathtubs in adjoining rooms are located in the wall between them. Even when a pipe is accessible, sometimes the pipes are so old and rusted that they collapse when a standard pipe wrench is attached to them and turned at a substantial distance from the joint which it is desired to disassemble. Mother problem installation is often presented by the drain pipe under a sink, which is often badly rusted and difficult to reach.

Thus there is a need for a wrench which can be operated or turned at a location somewhat removed from the particular pipe joint which it is desired to disassemble or assemble and which will apply force adjacent to or near the remotely located joint.

SUMMARY OF THE INVENTION

The tubular pipe wrench of the invention includes a cylindrical camming head having internal camming surfaces such that the cross-section of the head is similar to a triangle with deeply rounded corners. Located at the apexes of the triangle are three camming jaws having teeth adapted to grip the pipe which is desired to turn. The fiats between the jaws are cam surfaces against which the jaws are wedged. Each of these jaws are each held in place by a pair of bolts which pass through slots in the sidewall of the camming head. A sleeve is placed over the camming head and serves to retain the relative orientation of the bolts so that the camming jaws all operate in unison.

At the end of the camming head remote from the pipe joint which it is desired to assemble or disassemble, are a plurality of projections which are designed to mate with similar projections of an extension member to make a castellated interlocking connection with the extension. The projections are held together by means of a snap ring which is placed in a circumferential groove surrounding all the projections of the mating pieces when assembled. Such an extension is normally cylindrical with an internal diameter sufficient to clear a pipe of the diameter which it is desired to remove or replace, and will have similar projections at its opposite end to make a similar interlocking connection either with an additional such extension or with a drive member. Such a drive member has mating projections and flats to be operated by a conventional wrench such as a socket or crescent wrench and preferably also has an internal diameter sufficient to clear the pipe to be removed or replaced. Any such additional interlocking joints are also secured by means of a snap ring in a circumferential groove.

With the above described wrench, the camming head is placed over the pipe to be removed or installed with the camming jaws placed as closely as possible to the threaded connection. A slight turn of the wrench causes the jaws to become wedged between the pipe and the cam surfaces, after which the assembly may be turned by a wrench applied to the drive member.

DESCRIPTION OF THE PREFERRED EMBODIMENT

Figure 1:
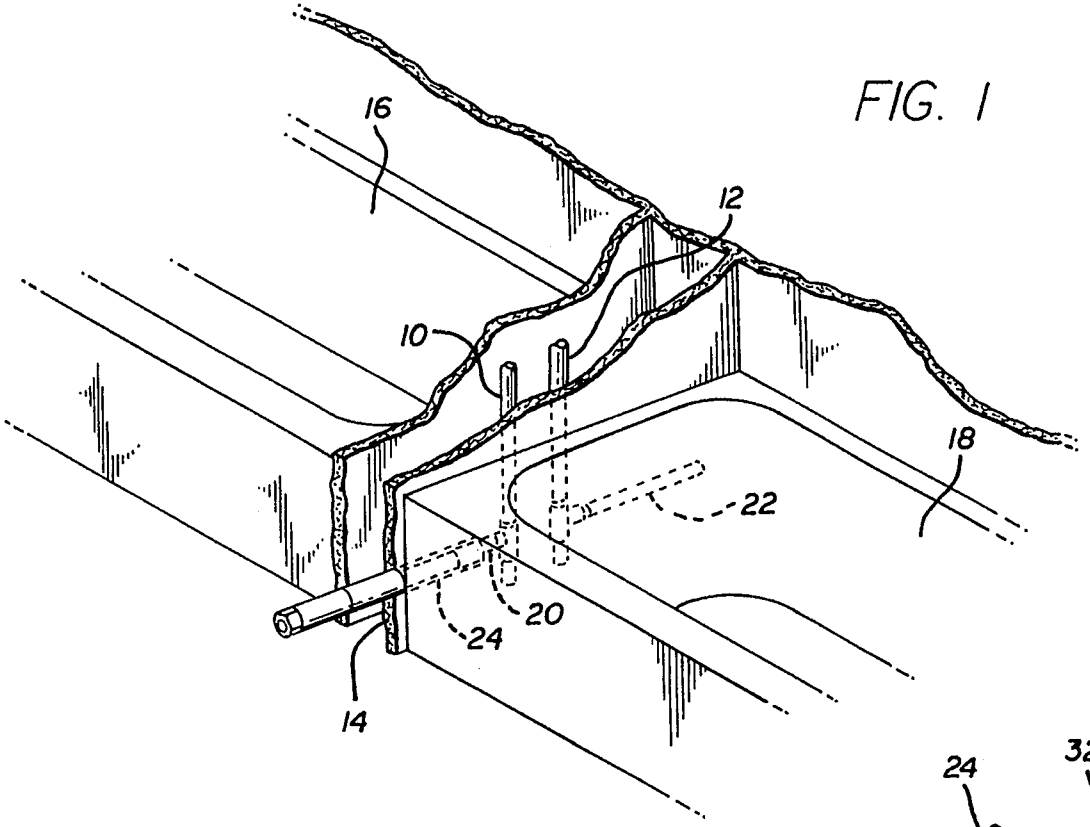
FIG. 1 is a perspective view showing the tubular wrench of the invention as it is used in a typical difficult plumbing application.

Referring now to FIG. 1, a plumbing installation is shown in which a pair of vertical pipes 10, 12 are shown located in a wall 14. On opposite sides of the wall 14 are bathtubs 16 and 18 which are each supplied with water from pipes 10 and 12 (connecting faucets, etc. not shown). Supply pipes 20 and 22 are connected to pipes 10 and 12 respectively. This is a typical plumbing installation in which applicant's tubular pipe wrench 24 becomes especially useful. It is now desired to remove and replace pipe 20. With tubular wrench 24 attached as shown near the threaded connection of pipe 20 to pipe 10, and with the hexagonal drive section easily accessible, a crescent or other suitable wrench can be attached to the hexagonal drive section to turn pipe 20.

Were a conventional pipe wrench to be attached to the exposed end of pipe 20 at the substantial distance from the threaded connection to pipe 10, there is a good chance that pipe 20, if old or rusted, will be unable to absorb the torsion force and will collapse. Also, should pipe 20 be much shorter than illustrated, there would be inadequate room to operate a conventional pipe wrench in the wall 14, and the length of tubular pipe wrench 24 would become necessary to reach the portion of pipe 20 near the threaded connection.

Figure 2:
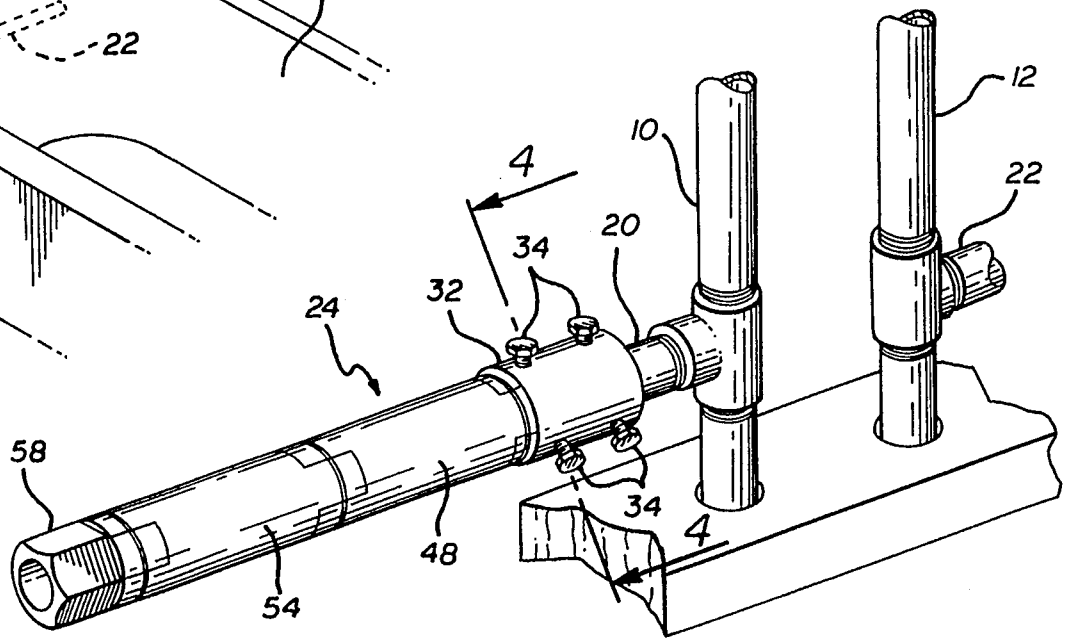
FIG. 2 is an enlarged perspective view of a portion of FIG. 1 showing the tubular wrench of the invention in greater detail.

FIG. 2 is an enlarged perspective view of a portion of FIG. 1 and shows the tubular wrench of the invention in somewhat greater detail. The tubular wrench 24 is shown surrounding and grasping pipe 20. It could be turned counter-clockwise to remove pipe 20 or clockwise to turn in and tighten pipe 20. Shown in the view are sleeve 32 which covers a cam ming hand with pipe contacting jaws described below and bolts 34 which hold the camming jaws and camming head in the desired relationship, also discussed below. Attached to the camming head by means of intersecting projections forming a castellated inter connection is an extension member 48, to which is attached by similar means a second extension member 54. A hex drive head 58 is connected to extension 54 through similar interconnecting projections and each such interconnection includes a part of an annular groove which is part of each projection, the groove being completed when the parts are assembled together. Into each such groove is placed an snap ring which effectively locks the parts together and prevents axial movement.

Figure 3:
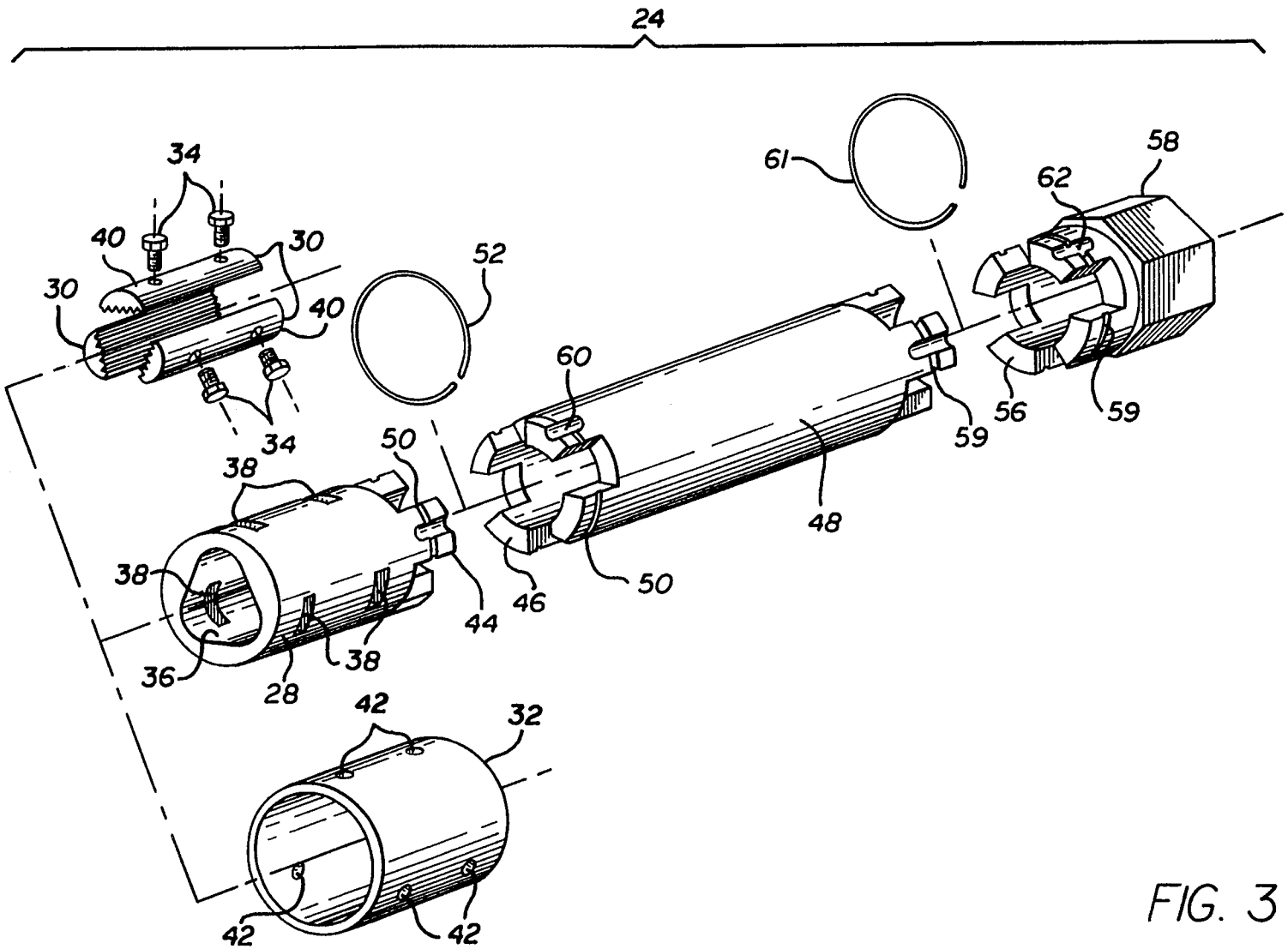
FIG. 3 is an exploded view of the tubular wrench of the invention.

FIG. 3 is an exploded view of the tubular pipe wrench 24 showing its several parts. The portion which actually grips the pipe which it is desired to turn consists of the camming head 28 with cam ming jaws 30, sleeve 32 and bolts 34. Camming head 28 is generally cylindrical with internal cam surfaces 36, giving it an internal cross section similar to a triangle with very rounded corners. The three camming jaws 30 are positioned in the rounded corners such as to leave clearance for the pipe to be turned. Note that the camming head 28 has a plurality of slotted openings 38 which align with threaded ports 40 in the camming jaws 30. Also aligned with slotted openings 38 are ports 42 in the sleeve 32. Bolts 34 pass through ports 42, slotted openings 38, and are threaded into the threaded ports 40 of the camming jaws to hold the camming jaws 30 in position in camming head 28, while permitting some relative movement of the jaws 30 with respect to camming head 28.

At one end of camming head 28 are a plurality of projections 44 which mate with comparable projections 46 on an extension member 48. When projections 44 and 46 are engaged, grooves 50 on their surfaces define a circumferential groove into which is placed a wire snap ring 52 which effectively locks the extension 48 to camming head 28. Extension member 48 has similar projections at its opposite end which can be connected in the same manner with an additional extension member or with projections 56 of a generally cylindrical drive head 58 having a surface with a hexagonal cross section defining six flat areas to receive jaws of a conventional wrench such as a socket wrench, a crescent wrench, open end wrench, etc. Each of extension member 48 and drive head 58 includes a portion of a circumferential groove 59 for receiving a snap ring 61. Small slots 60 and 62 undercut grooves 50 and 59, respectively to provide tool access to remove the snap rings 52 and 61.

The interlocking connector arrangement shown and described works very well and transfers torque equally well in both directions. It is recognized, however, that this interconnecting structure is relatively expensive and somewhat simpler structures such as placing pins through mating holes of telescoping parts to be joined may be acceptable for some applications.

Camming head 28 and camming jaws 30 may vary in length over a significant range and still function adequately. For pipes in the order of one and one half inches in outside diameter, a length of two inches for camming head 28 has been found adequate. It will be recognized that, as compared with a conventional pipe wrench which has two jaws which are usually less than about 1 inch in width, the present device distributes force over three jaws of considerably greater length, hence, concentrates less force over a given area with less danger of collapsing pipes or severely damaging pipe threads.

The extension member 48 as shown in FIG. 2 may be made about nine inches long. Two or more such extensions may be used when necessary. The hex drive head 58 can be made over varying lengths, however, unless it is built to include a length of extension, it needs only to be long enough to provide an adequate length of hexagonal surface for contact with the driving wrench plus the length of the projections for the connecting structure. While a hexagonal drive is preferred, those skilled in the art will recognize that a square drive head or other non circular drive head may also be acceptable for some applications.

Figure 4:
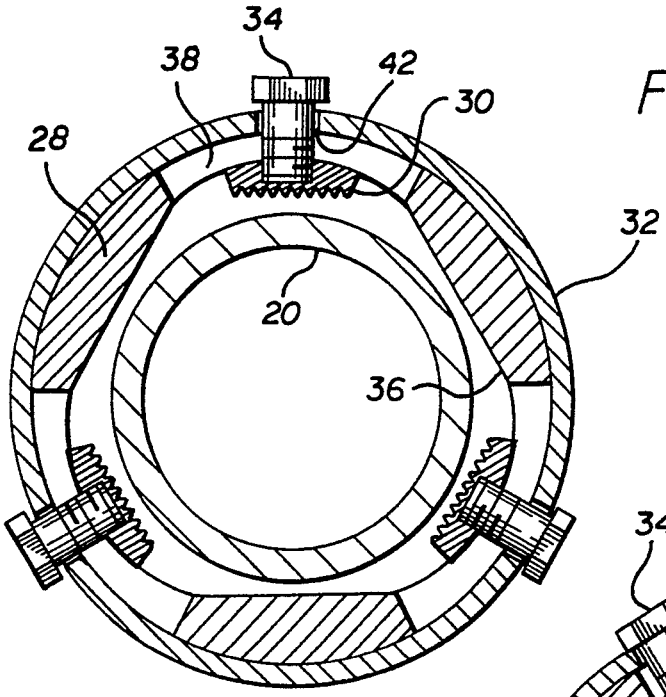
FIGS. 4, 5 and 6 are cross sectional views taken along line 4—4 of FIG. 3 showing the positions of the parts during different operating conditions.
Figure 5:
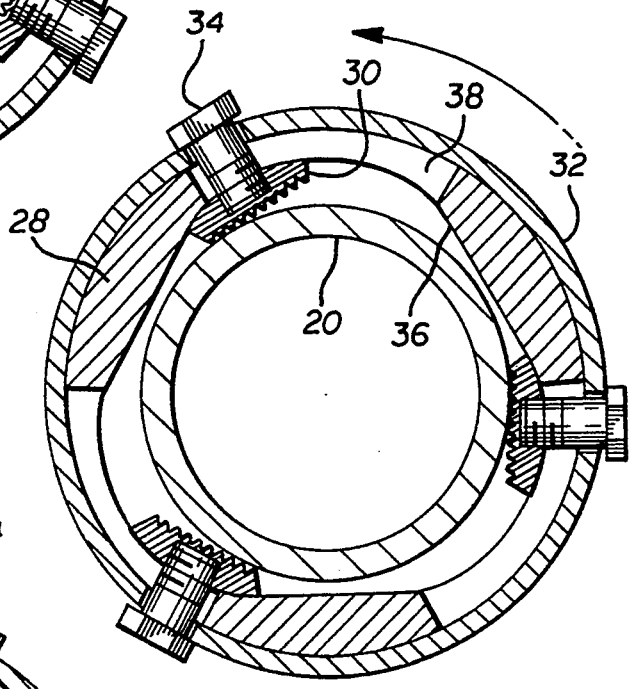
Figure 6:
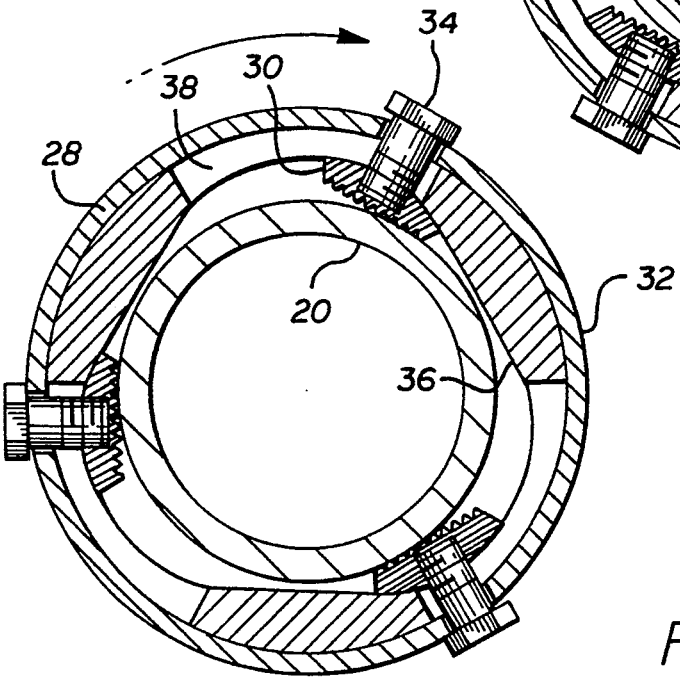

FIGS. 4, 5, and 6 are cross sectional views taken along line 4—4 of FIG. 3. FIG. 4 shows the position of the parts at rest with no torque applied to the pipe 20. The camming head 28 surrounds the pipe and is covered by the sleeve 32. Passing through ports 42 in the sleeve are bolts 34 which also pass through the slotted openings 38 in camming head 28 and are threadedly engaged with ports 40 in the camming jaws 30. The jaws 30 are shown out of contact with the pipe 20.

FIG. 5 shows the parts of FIG. 4 as they are displaced when the camming head 28 is turned in a clockwise direction. As the camming head is turned, jaws 30 will contact pipe 20 and bolts 34 will be displaced along with the jaws toward the left end of the slotted opening 38 until jaws 30 become wedged between the pipe 20 and the cam surfaces 36. When the camming jaws become wedged as shown, the pipe 20 will also be rotated in a clockwise direction.

FIG. 6 shows the positions of the parts described above when the camming head 28 is rotated counter clockwise. The operation is analogous to that described relative to FIG. 5. Once the jaws 30 make contact with the pipe 20, they are moved across their respective slotted openings 38 toward the right until they become wedged between pipe 20 and the cam surface 36 nearest the opposite end of the slotted opening. Thus it will be recognized that no removal of the tubular wrench is required to reverse directions since only a slight radial displacement of the camming head causes the jaws to shift from one cam surface to another to cause the pipe 20 to reverse from clockwise to counter-clockwise direction.

Aside from the obvious advantages of being able to turn a pipe at a distance, it will be recognized that the tubular wrench of the invention is inherently self centering and that it can enter an opening concentric with the pipe and only slightly larger than the pipe. The wrench can also be used to conveniently install threaded nipples without damage to the threads. In some cases, it is helpful to wrap threaded portions of the nipple in contact with the jaws with a layer of tape.

While only a single embodiment has been shown and described herein, modifications will be apparent to those skilled in the art and I do not desire to be limited except by the following claims and their equivalents.

I claim:

1. A tubular pipe wrench comprising a generally cylindrical camming head having internal cain surfaces, camming jaws in said camming head, slotted openings in said camming head, a sleeve surrounding said camming head, and bolts passing through said sleeve and said slotted openings and threadedly engaged with said camming jaws, and generally cylindrical drive means connected to said camming head including flats on the surface thereof.

2. A tubular pipe wrench in accordance with claim 1 wherein said generally cylindrical drive means includes a separate generally cylindrical extension member.

3. A tubular pipe wrench in accordance with claim 1 wherein said cylindrical drive means includes a hexagonal wrench receiving portion.

4. A tubular pipe wrench in accordance with claim 1 wherein said cylindrical drive means is connected to said camming head through castellated connecting means.

5. A tubular pipe wrench in accordance with claim 4 wherein said castellated connecting means includes mating projection parts, cooperating grooves on said projection parts and snap rings in said grooves.

6. A tubular pipe wrench for turning a pipe comprising a generally cylindrical camming head having internal cam surfaces and a plurality of generally circumferential slotted openings, said cam surfaces being equally spaced and including substantial uncurved areas;

camming jaws in said camming head carried between said cam surfaces;

a sleeve surrounding said camming head including a plurality of fastener receiving ports;

fastening means passing through said ports and said slotted openings loosely fastening said camming jaws in said camming head to permit said camming jaws to move relative to said camming head such that turning of said tubular pipe wrench on said pipe in either direction causes said camming jaws to be wedged between said pipe and said cam surfaces.

7. A tubular pipe wrench in accordance with claim 6 wherein drive means are connected to said camming head including wrench engaging surfaces.

8. A tubular pipe wrench for turning a pipe comprising a hollow generally cylindrical camming head having a plurality of internal cam surfaces, a plurality of camming jaws in said camming head between said cam surfaces, a plurality of slotted openings in said camming head, a sleeve surrounding said camming head and bolts passing through said sleeve and said slotted openings and threadedly engaged with said camming jaws to secure said camming jaws in said camming head, and drive means on one end of said camming head;

a cylindrical extension member including drive means at one end mating with the drive means of said camming head, and additional drive means on its other end; and a generally cylindrical drive member having flats on its surface and drive means mating with said additional drive means.

9. A tubular pipe wrench as claimed in claim 8 wherein said fastening means includes castellated connecting parts on said camming head, said drive member and said extension member.

10. A tubular pipe wrench as claimed in claim 9 wherein said fastening means includes snap ring members securing said castellated connecting parts.

11. A tubular pipe wrench as claimed in claim 9 wherein said castellated interconnecting means includes circumferential grooves and said fastening means includes snap rings in said grooves.

12. A tubular pipe wrench as claimed in claim 8 wherein turning said drive member with said pipe positioned in said camming head, causes said camming jaws to be wedged between said cam surfaces and said pipe.

13. A tubular pipe wrench comprising a camming head having internal cam surfaces, camming jaws in said camming head, slotted openings in the sidewalls of said camming head, a sleeve surrounding said camming head and bolts passing through said sleeve and said slotted openings and threadedly engaged with said camming jaws to secure said camming jaws in said camming head, a plurality of projections at one end of said camming head and circumferential grooves on said projections;

a cylindrical extension member having projections at each end and circumferential grooves on said projections which align with said circumferential grooves on the projections of said camming head, said projections mating with the projections on said camming head, a generally cylindrical drive member having projections with circumferential grooves mating with the projections of said extension member and having flats on its surface, and snap rings in said circumferential grooves to secure said camming head, extension member and drive members.

* * * * *

UNITED STATES PATENT AND TRADEMARK OFFICE

CERTIFICATE OF CORRECTION

PATENT NO. : 5,349,887

DATED : Sep. 27, 1994

INVENTOR(S) : Kaye Suwa

It is certified that error appears in the above-identified patent and that said Letters Patent is hereby corrected as shown below:

Column 1, line 29, cancel "Mother" and insert ---Another---.

Signed and Sealed this

Seventeenth Day of September, 1996

Bruce Lehman

*Attest:*

BRUCE LEHMAN

*Attesting Officer*

*Commissioner of Patents and Trademarks*